US008911598B2

(12) United States Patent
Chen et al.

(10) Patent No.: US 8,911,598 B2
(45) Date of Patent: Dec. 16, 2014

(54) ANODIZING PROCESSING LINE

(75) Inventors: Shun-Ho Chen, Taipei Hsien (TW); Dong-Sheng Lin, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 1132 days.

(21) Appl. No.: 12/846,854

(22) Filed: Jul. 30, 2010

(65) Prior Publication Data

US 2011/0132746 A1 Jun. 9, 2011

(30) Foreign Application Priority Data

Dec. 9, 2009 (CN) ..... 2009 1 0311118

(51) Int. Cl.
*C25D 11/02* (2006.01)
*C25D 17/00* (2006.01)
*C25D 11/00* (2006.01)

(52) U.S. Cl.
CPC ..... *C25D 11/005* (2013.01); *C25D 11/02* (2013.01)
USPC ..... 204/198; 204/275.1; 204/297.06; 414/749.1

(58) Field of Classification Search
USPC ..... 52/79.5; 414/749.6
See application file for complete search history.

(56) References Cited

U.S. PATENT DOCUMENTS 4,318,793 A * 3/1982 Ando et al. ..... 204/198
4,371,075 A * 2/1983 Erlichman ..... 198/345.3
4,377,461 A * 3/1983 Lovejoy ..... 204/198
4,401,522 A * 8/1983 Buschow et al. ..... 205/145
4,762,218 A * 8/1988 Sticht ..... 198/345.3
4,851,098 A * 7/1989 Kimura et al. ..... 204/198
4,860,778 A * 8/1989 Pohl ..... 135/97
5,069,760 A * 12/1991 Tsukamoto et al. ..... 205/80
5,181,354 A * 1/1993 Krueger et al. ..... 52/79.1
5,441,618 A * 8/1995 Matsuda et al. ..... 204/203
5,539,975 A * 7/1996 Kukuljan et al. ..... 29/701
6,354,431 B1 * 3/2002 DeCecca et al. ..... 198/775
6,745,454 B1 * 6/2004 Grimshaw et al. ..... 29/563
7,278,273 B1 * 10/2007 Whitted et al. ..... 62/259.2
7,371,306 B2 * 5/2008 Davis et al. ..... 156/345.22
2001/0030101 A1 * 10/2001 Berner et al. ..... 198/346.1
2003/0175182 A1 * 9/2003 Teall et al. ..... 422/188
2006/0037855 A1 * 2/2006 Hanson et al. ..... 204/198
2008/0169169 A1 * 7/2008 Huebner ..... 198/345.3
2009/0277748 A1 * 11/2009 Spangler et al. ..... 198/345.3
2012/0077429 A1 * 3/2012 Wernimont et al. ..... 454/187

FOREIGN PATENT DOCUMENTS

CN 1663554 A 9/2005
CN 201276536 Y 7/2009

* cited by examiner

*Primary Examiner* — Harry D Wilkins, III
(74) *Attorney, Agent, or Firm* — Novak Druce Connolly Bove + Quigg LLP

(57) ABSTRACT

A production line includes a number of production units, production equipments and a sliding bracket. The sliding bracket slides between the production units. Each production unit includes at least one base unit which is made in series. The at least one base unit has an enclosure. The sliding bracket and the production equipment are received in the enclosure. The production units are arranged in a configuration such as straight line, U-shaped or rectangular.

10 Claims, 5 Drawing Sheets

ANODIZING PROCESSING LINE

BACKGROUND

1. Technical Field

The present disclosure relates to production lines, and particularly, to a portable/moveable production line.

2. Description of the Related Art

A conventional production line includes a number of production devices connected to each other. Because the market requirements change rapidly, the production line must also be changed as quickly as possible. When the production line is replaced or moved, the production devices must be detached from each other, and then reassembled. This results in a higher cost and is very time consuming to replace or move the production line.

Therefore, there is room for improvement within the art.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout several views, and all the views are schematic.

DETAILED DESCRIPTION

Figure 1:
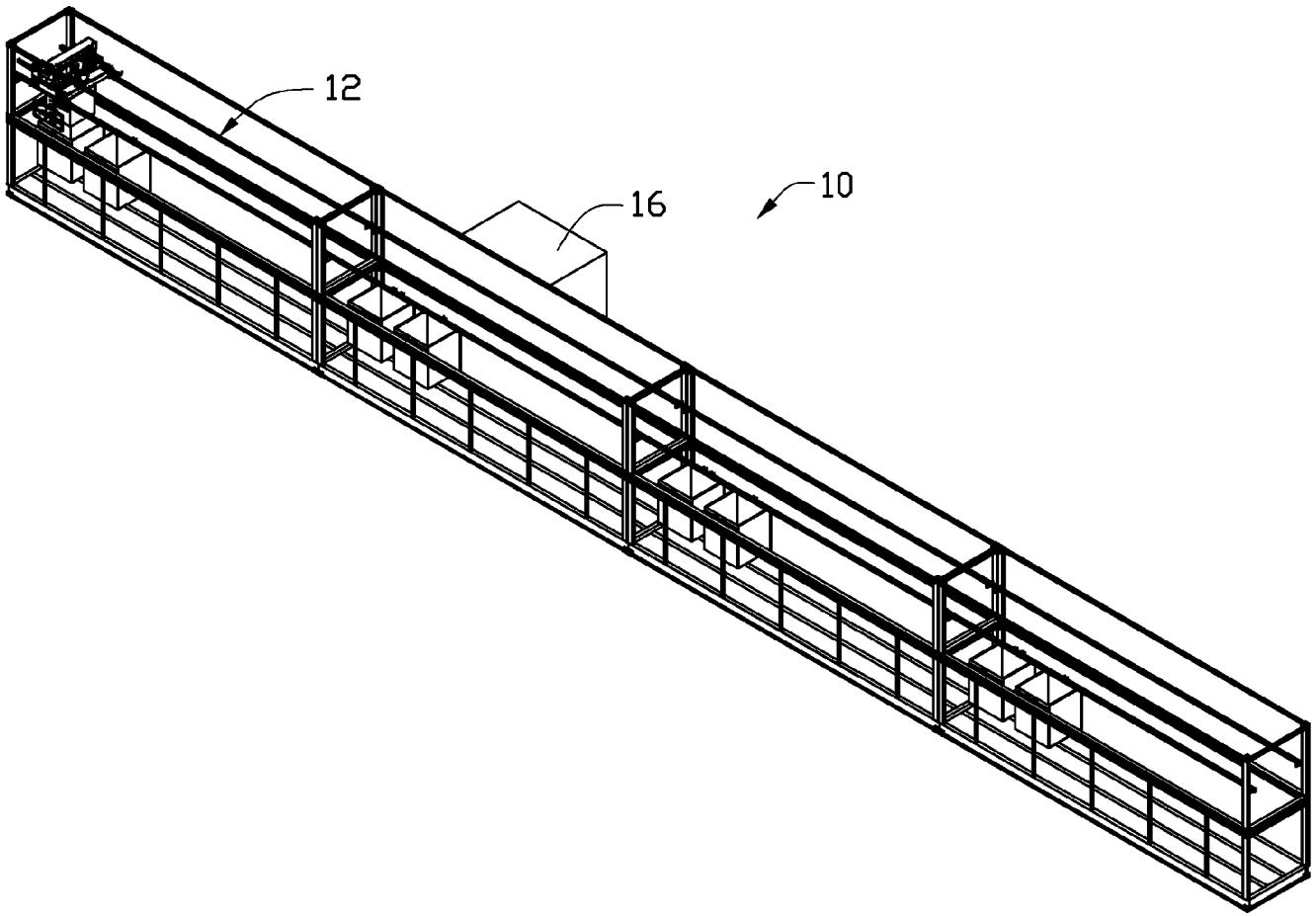
FIG. 1 is an isometric view of a first embodiment of a production line which includes a plurality of production units.

Referring to FIG. 1, a first embodiment of a production line 10 includes a number of production units 12 and a number of production devices or equipments (not shown). The number of the productions units 12 used is decided by a plurality of production requirements. In this embodiment, the production line 10 is an anodizing production line, and includes four production units 12 and a periphery device 16. The four production units 12 are arranged in a straight line. The periphery device 16 is selected from a number of devices that can include, for example, a cooling device, or a mixing device.

Figure 2:
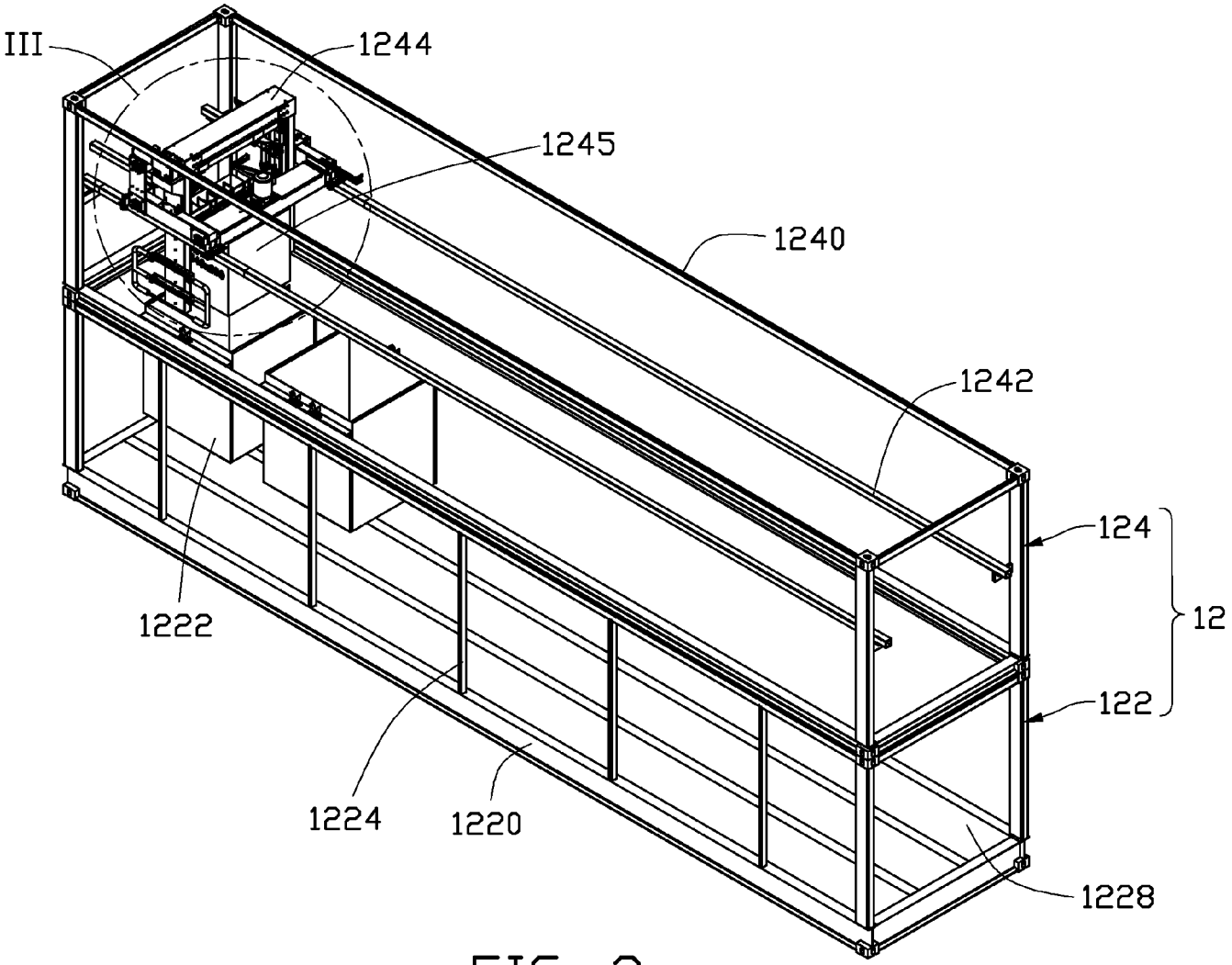
FIG. 2 is an isometric view of one production unit shown in FIG. 1.
Figure 3:
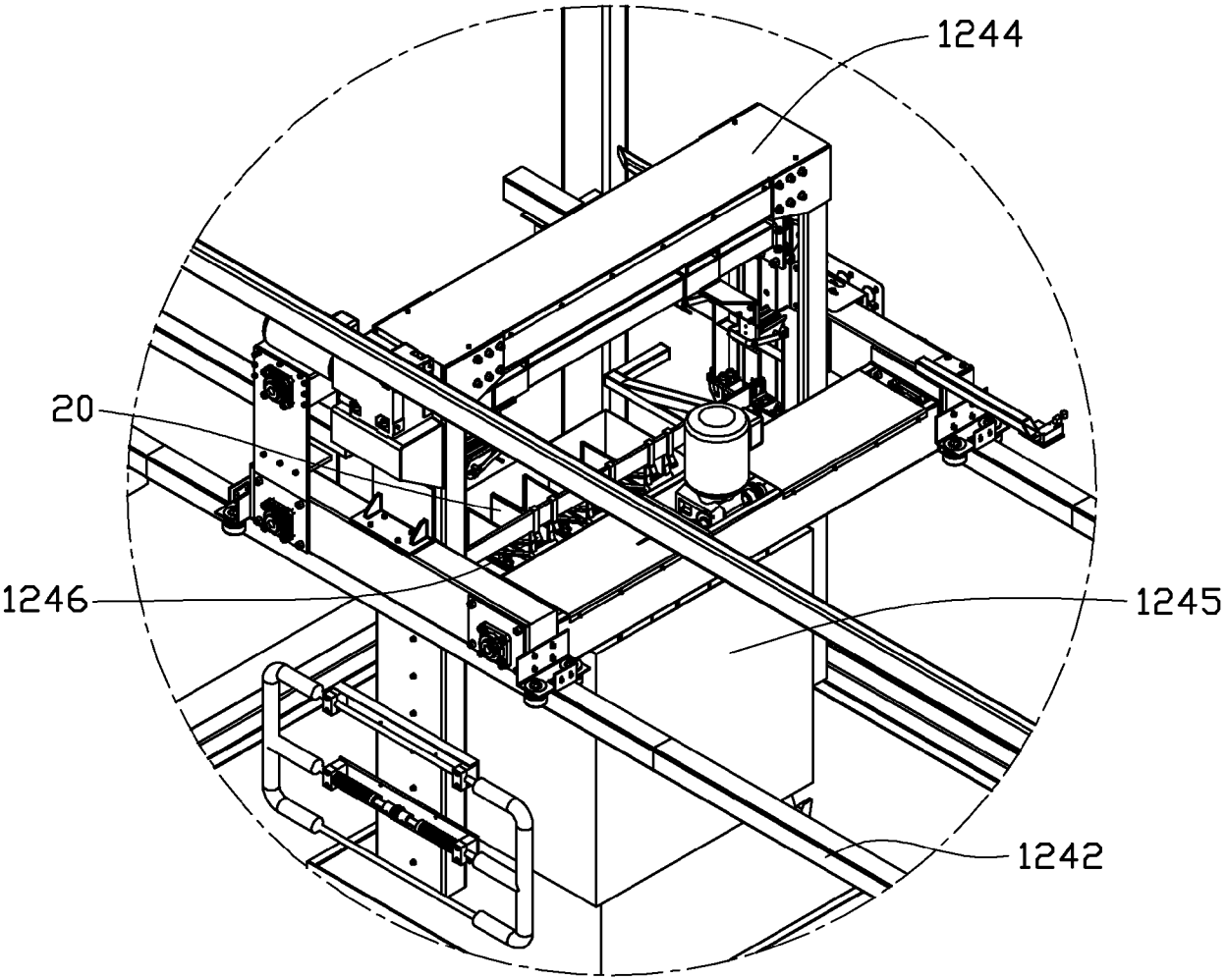
FIG. 3 is an enlarged view of a circular part III shown in FIG. 2.

Referring to FIGS. 2 and 3, each production unit 12 includes a first base unit 122 and a second base unit 124. The second base unit 124 is stacked on the first base unit 122. The first base unit 122 and the second base unit 124 are both substantially cuboid in shape. In the illustrated embodiment, both the first base unit 122 and the second base unit 124 are in intermodal and independent container types, and the first base unit 122 and the second base unit 124 are a plurality of frames for enclosures, as it is more convenient for transport.

The first base unit 122 and the second base unit 124 can be made in series. In other words, the first base unit 122 and the second base unit 124 are made to be substantially the same size and structure, for assembly for different production lines. For example, the base units can be made in three different models/configurations, namely, A, B, C with each model/configuration having the same size and structure. These different models of the first base unit 122 and the second base unit 124 are assembled to different production lines.

The first base unit 122 includes a first bracket 1220, a number of tanks 1222, a number of reinforcing ribs 1224 and a base plate 1228 in this embodiment, the first bracket 1220 is a frame of an intermodal container. The tanks 1220 are fixedly assembled in the bracket 1220. The reinforcing ribs 1224 are fixed onto the first bracket 1220, respectively, to strengthen the stability of the first bracket 1220 The base plate 1228 is fixed on the bottom of the first bracket 1220.

In this embodiment, the first base unit 122 includes a number of tanks 1222 to contain a plurality of different chemical solvents such as, for example, degreasing solvent, water or alkaline solvents.

The second base unit 124 includes a second bracket 1240, two crossbeams 1242, a sliding bracket 1244, a lifting bracket 1245 and a plurality of racks 1246. In this embodiment, the second bracket 1240 is the frame of an intermodal container. The two crossbeams 1242 are fixed on the second bracket 1240, and extended along the direction of the length of the second base unit 124. When the production units 12 are connected to each other, the crossbeams 1242 cooperatively form a pair of guide rails. The sliding bracket 1244 is slidably disposed between the two crossbeams 1242, so that the sliding bracket 1244 can slide along a direction along the length of the second base unit 124. The lifting bracket 1245 is disposed on the sliding bracket 1244, and slides along a direction perpendicular to the direction of the length of the second base unit 124. The racks 1246 are hung on the lifting bracket 1245. A plurality of workpieces 20 is fixed to the racks 1246.

The production line 10 is placed in a sealed box, so that the chemical solvents used in the anodizing method are sealed in the sealed box. The sealed box can be supported by the first bracket 1220 and the second bracket 1240, thereby the sealed box does not have a frame.

When the production line 10 is used for anodizing method, the workpieces 20 are fixed to the racks 1246. The tanks 1222 are filled with different chemical solvents used in the anodizing method. The anodizing method includes the following steps:

(a) The sliding bracket 1244 is moved to a first tank 1222. The first tank 1222 is filled with a degreasing solvent. The lifting bracket 1245 is descended into the degreasing solvent, so that the workpieces 20 are immersed in the first tank 1222 to degrease. The lifting bracket 1245 is then ascended after the workpieces 20 are degreased.

(b) The sliding bracket 1244 is moved to a second tank 1222. The second tank 1222 is filled with water. The lifting bracket 1245 is descended into the water, so that the workpieces 20 are immersed in the second tank 1222 to clean.

(c) The sliding bracket 1244 is moved to another tank 1222. The workpieces 20 are processed to receive other treatments.

Figure 4:
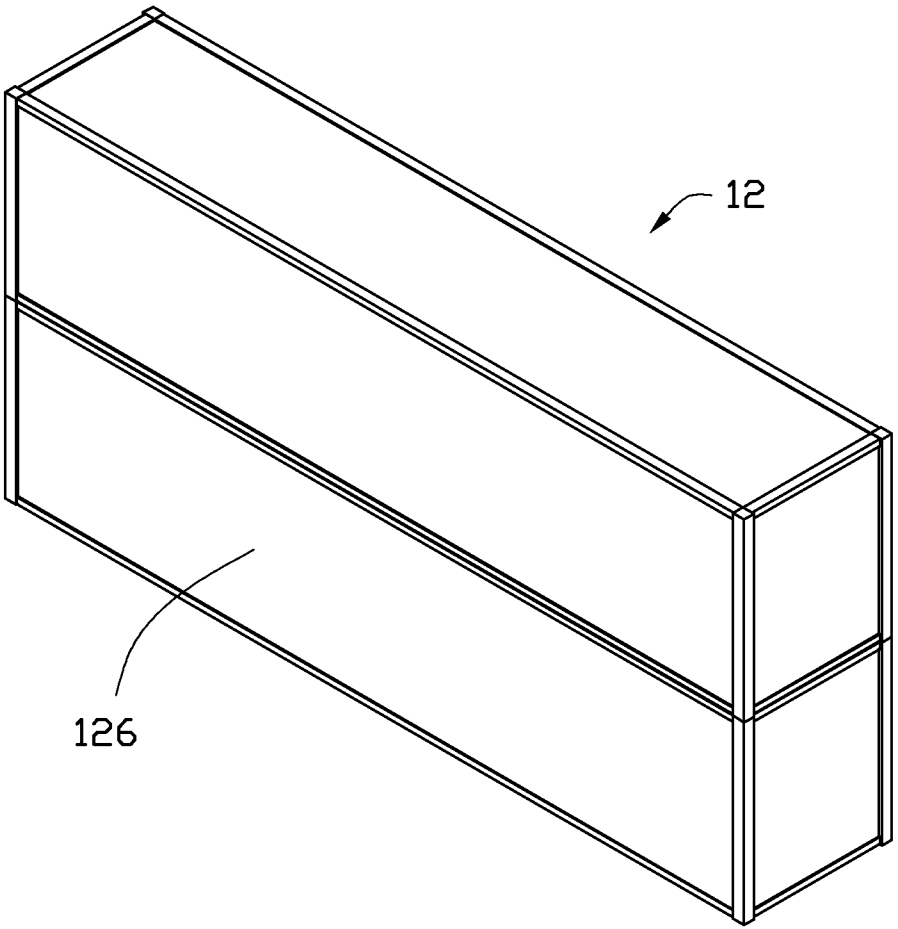
FIG. 4 is an isometric view of a transporting state of the production units shown in FIG. 1.

When the production line 10 is being relocated, the first base unit 122 and the second base unit 124 are detached from each other, so that the first base unit 122 and the second base unit 124 are separate enclosures. Referring to FIG. 4, the first base unit 122 and the second base unit 124 further include a plurality of plates 126. The plates 126 are mounted on a bottom surface, two side surfaces and a top surface of the first bracket 1220 and the second bracket 1240, respectively, so that the first base unit 122, the second base unit 124, and the plates 126 cooperatively form a sealed space. The tanks 1222, the sliding bracket 1244, the lifting bracket 1245 and the racks 1246 are placed into the sealed space. Therefore, the production line 10 is moved conveniently, and avoids contamination.

The first base unit 122 and the second base unit 124 are made in series, so that the production line 10 is assembled or disassembled more conveniently. Furthermore, the first base unit 122 and the second base unit 124 are enclosures, for more convenient transportation.

The production line 10 only requires one set of sliding brackets 1244, lifting brackets 1245 and racks 1246, thereby only one second base unit 124 requires to have the sliding brackets 1244, the lifting brackets 1245 and the racks 1246.

It is to be understood that the production line 10 is not limit to be an anodizing procession line, and can also be other types of production or processing lines. The racks 1246 can also be omitted, and instead a clamped structure may be used. The production line 10 is not limited to be arranged in a straight line, and can also be U-shaped, rectangular, or round. The production line 10 can also include a driving device such as a cylinder or a motor. The driving device drives the sliding bracket 1244 to slide or drives the lifting bracket 1245 to move.

It is to be understood that the first base units 122 of the production unit 12 can be fixed to the ground. The second base units 124 of the production unit 12 are fixed to the first base units 122 with a number of fixing structures.

Figure 5:
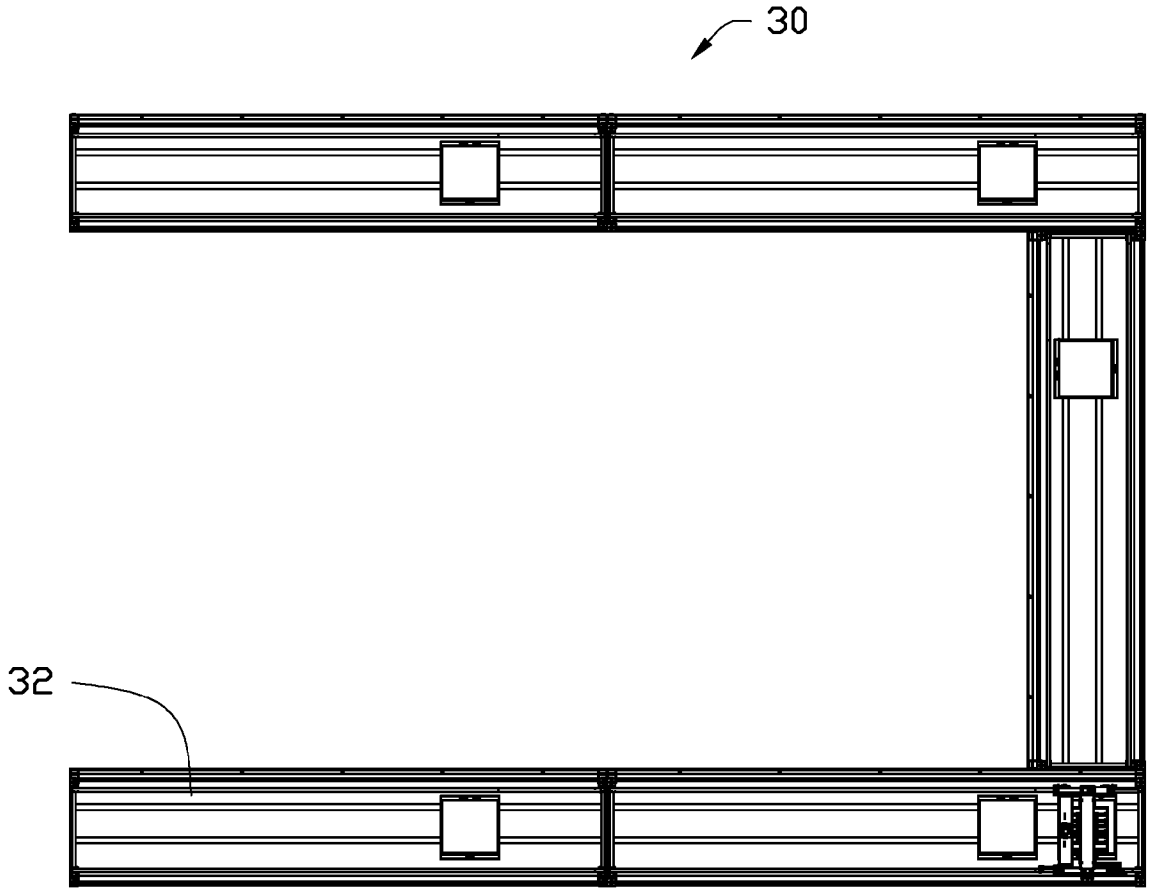
FIG. 5 is a top plane view of a second embodiment of a production line.

Referring to FIG. 5, a second embodiment of a production line 30 is shown, differing from the first embodiment only in that five production units 32 are arranged in U-shaped configuration.

Finally, while the present disclosure has been described with reference to particular embodiments, the description is illustrative of the disclosure and is not to be construed as limiting the disclosure. Therefore, various modifications can be made to the embodiments by those of ordinary skill in the art without departing from the true spirit and scope of the disclosure as defined by the appended claims.

What is claimed is:

1. An anodizing processing line comprising:

a production unit comprising a plurality of base units made in series, and comprising an enclosure and a plurality of production devices assembled into the enclosure, wherein each base unit comprises a first base unit and a second base unit stacked on the first base unit, the first base unit is an intermodal container type and comprises a first bracket and at least one tank fixedly assembled in the first bracket, the first bracket is a frame of an intermodal container, the at least one tank is configured for containing a plurality of different chemical solvents, the second base unit is an intermodal container and comprises a second bracket, two crossbeams fixed on the second bracket, a sliding bracket slidably disposed between the two crossbeams along a first direction, a lifting bracket slidably located on the sliding bracket along a second direction substantially perpendicular to the first direction, and a plurality of racks hung on the lifting bracket, and the second bracket is a frame of an intermodal container, wherein the plurality of base units are connected to each other and arranged in line, such that independent crossbeams of all the plurality of base units cooperatively form a pair of guide rails.

2. The anodizing processing line of claim 1, wherein each of the first base unit and the second base unit further comprises a plurality of plates mounted on a bottom surface, two side surfaces and a top surface of the first bracket and the second bracket, respectively.

3. The anodizing processing line of claim 2, wherein the plurality of base units form a sealed space.

4. The anodizing processing line of claim 1, wherein the first base unit is detachably fixed to the second base unit.

5. The anodizing processing line of claim 1, wherein each of the plurality of base units has the same size and structure.

6. An anodizing processing line comprising:

a plurality of production units; and a plurality of production equipments, wherein each production unit comprises a plurality of base units made in series, the at least one base unit defines an enclosure, the production equipments are received in the enclosure, the at least one base unit comprises a first base unit and a second base unit stacked on the first base unit, the first base unit is an intermodal container type and comprises a first bracket and at least one tank fixedly assembled in the first bracket, the first bracket is a frame of an intermodal container, the at least one tank is configured for containing a plurality of different chemical solvents, the second base unit is an intermodal container type and comprises a second bracket, two crossbeams fixed on the second bracket, a sliding bracket slidably disposed between the two crossbeams along a first direction, a lifting bracket slidably located on the sliding bracket along a second direction substantially perpendicular to the first direction, and a plurality of racks hung on the lifting bracket, and the second bracket is a frame of an intermodal container, wherein the plurality of base units are connected to each other and arranged in line, such that independent crossbeams of all the plurality of base units cooperatively form a pair of guide rails.

7. The anodizing processing line of claim 6, wherein the first base unit and the second base unit further include a plurality of plates mounted on a bottom surface, two side surfaces and a top surface of the first bracket and the second bracket, respectively.

8. The anodizing processing line of claim 7, wherein the the plurality of base units form a sealed space.

9. The anodizing processing line of claim 6, wherein the first base unit is detachably fixed to the second base unit.

10. The anodizing processing line of claim 6, wherein the production units are arranged in a configuration selected from a group consisting of straight line, U-shaped or rectangular.

* * * * *